US006443364B1

(12) United States Patent
Lin

(10) Patent No.: US 6,443,364 B1
(45) Date of Patent: Sep. 3, 2002

(54) CANDLE STAND IN COMBINATION WITH A FOUNTAIN

(76) Inventor: Chung-Kuei Lin, 6F-4, No. 1, Wu-Chuan 1st Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/002,546

(22) Filed: Nov. 1, 2001

(51) Int. Cl.[7] ..... B05B 17/08; B05B 15/00

(52) U.S. Cl. ..... 239/17; 239/18; 239/20; 239/193; 239/289; 431/253; 431/289

(58) Field of Search ..... 239/17, 18, 20, 239/21, 22, 193, 211, 289, 23; 431/253, 289; D26/9, 23

(56) References Cited

U.S. PATENT DOCUMENTS 871,191 A * 11/1907 Southam ..... 239/23
3,713,583 A * 1/1973 Gruber ..... 239/17
4,568,269 A * 2/1986 Lin ..... 431/253
5,749,518 A * 5/1998 Wang ..... 239/17
5,934,557 A * 8/1999 Shih ..... 239/17
6,029,899 A * 2/2000 Walker ..... 239/17
6,076,741 A * 6/2000 Dandrel et al. ..... 239/18
6,305,108 B1 * 10/2001 Lin ..... 431/289

* cited by examiner

*Primary Examiner*—Steven J. Ganey
(74) *Attorney, Agent, or Firm*—Thorp Reed & Armstrong LLP

(57) ABSTRACT

A candle stand in combination with a fountain to provide ornamental effects includes a hollow base, a candle stand assembly, and a fountain assembly. A pump is disposed inside the base. The candle stand assembly is mounted on top of the base. The fountain includes a hollow connector and a tube communicating the connector to the pump. A bottom semi-sphere is disposed around the connector and on top of the cover plate. A top semi-sphere is disposed around the connector and above the cover plate. An upper plate and a lower plate are disposed around the connector and between the bottom semi-sphere and the top semi-sphere.

4 Claims, 3 Drawing Sheets

CANDLE STAND IN COMBINATION WITH A FOUNTAIN

BACKGROUND OF THE INVENTION

1. Field of the Invention

The present invention relates to a candle stand, and more particularly to a candle stand in combination with a fountain that has rearrangeable components to provide a variety of configurations for ornamental purpose.

2. Description of Related Art

Candles and candles stands are originally used to fulfill illuminating needs, but in today's modern world, since the invention of the electric light bulb, they have seldom been used to provide illumination. Instead candles and candle stands are now more considered to be ornamental objects that people would use to provide an effect such as a romantic ambience. Moreover, the candle stand itself without the candle can still be ornamental. Some fine candle stands are even regarded as works of art. Accordingly, the candle stands have historically been very popular and have been increasingly popular in recent years in accompaniment with the improving of people's living standards.

A fountain is also a popular apparatus used to provide an ornamental effect. By utilizing soothing water movement, the fountain shows a taste of elegance and therefore has been increasingly popular in recent years. However, the fountain currently available usually has an unchangeable configuration, and can not be rearranged to provide a variety of configurations which are able to bring different feelings to a person. Especially after a period of use, the fountain having an unchangeable configuration is dull and the person may desire to change the configuration of the fountain without purchasing a new one.

Therefore, the present invention tends to provide a candle stand in combination with a fountain to combine the advantages of a candle stand and a fountain and also overcome the aforementioned problem.

SUMMARY OF THE INVENTION

An objective of the present invention is to provide a candle stand in combination with a fountain to combine the advantages of a candle and a fountain for ornamental purpose.

Another objective of the present invention is to provide a candle stand in combination with a fountain that has rearrangeable components so as to provide versatile configurations.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
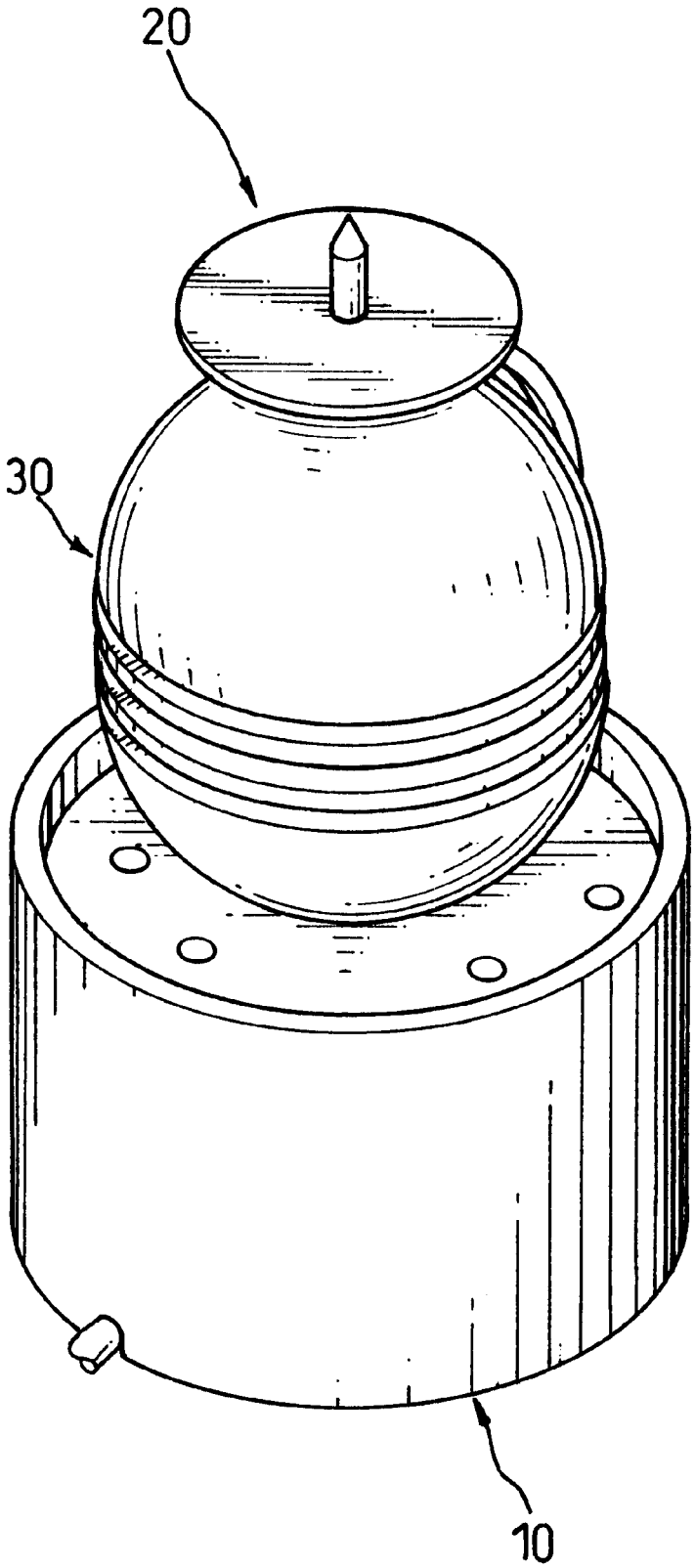
FIG. 1 is a perspective view of a candle stand in combination with a fountain in accordance with the present invention.

With reference to FIG. 1, a candle stand in combination with a fountain includes a base (10), a candle stand assembly (20), and a fountain assembly (30).

Figure 2:
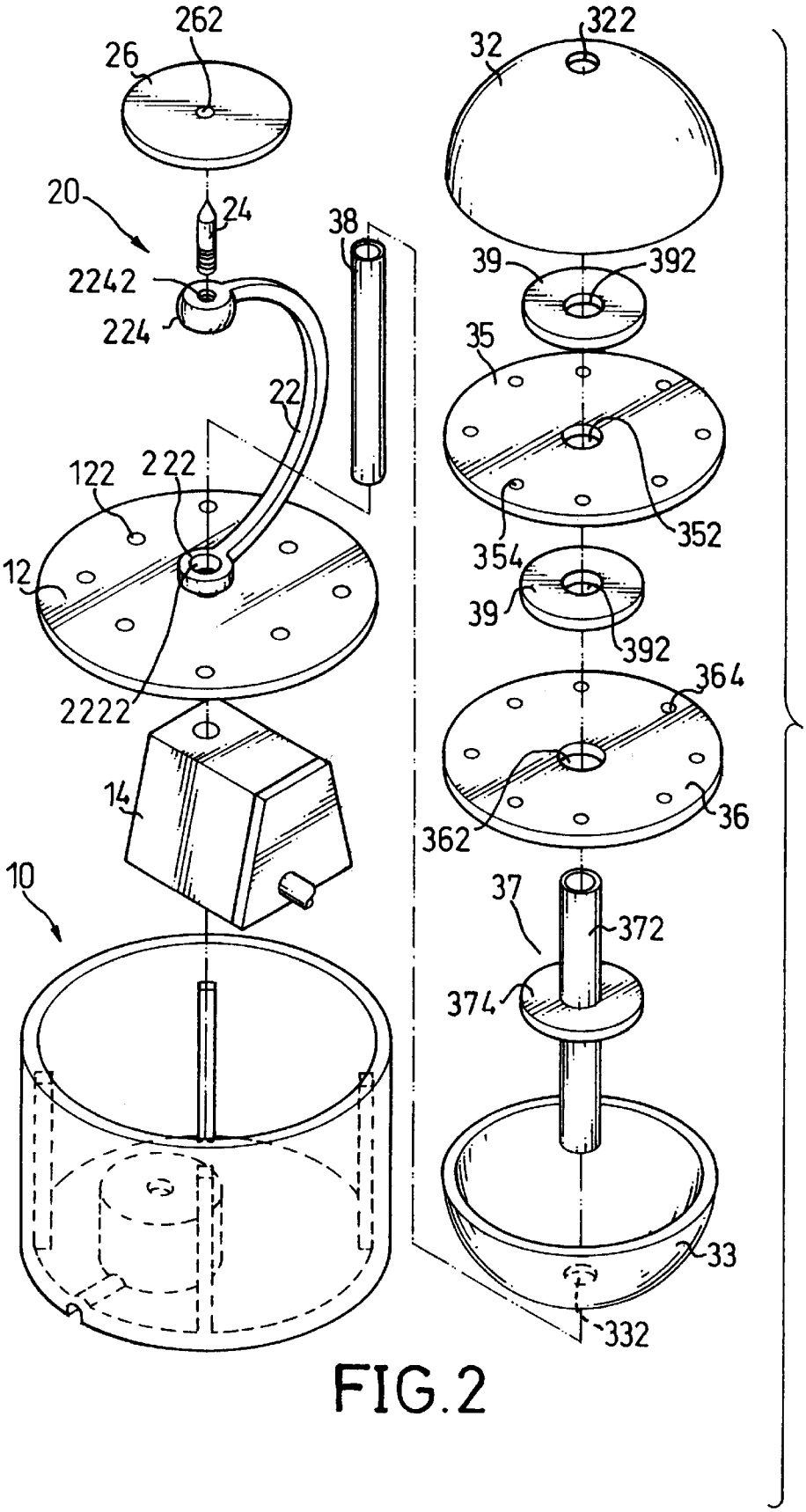
FIG. 2 is an exploded, perspective view of the candle stand in combination with the fountain in FIG. 1.

With reference to FIG. 2, the base (10) is a hollow cylinder having a top opening. A cover plate (12) with multiple through holes (122) is securely mounted in and covers the top opening. A pump (14) is disposed inside the base (10) and connected to a power supply (not shown).

The candle stand assembly (20) includes a bracket (22) which is arcuate and has a bottom end (222) securely connected to the center of a top face of the cover plate (12). A communicating hole (2222) is defined through the bottom end (222) and the center of the cover plate (12). The bracket (22) has a top end (224) defined with a threaded hole (2242). A pointed screw (24) is screwed into the threaded hole (2242) and the point is uppermost. A candle plate (26) having a center hole (262) is held on the top end (224) of the bracket (22) and securely retained by extending the pointed screw (24) through the center hole (262).

The fountain assembly (30) includes a top semi-sphere (32), a bottom semi-sphere (33), an upper plate (35), a lower plate (36), a connector (37), and a tube (38).

The top semi-sphere (32) and the bottom semi-sphere (33) are both hollow and each have an open side. A top bore (322) and a bottom bore (332) are respectively defined through the centers of the top semi-sphere (32) and the bottom semi-sphere (33).

The upper plate (35) and the lower plate (36) are both shaped as circular plates. An upper bore (352) and a lower bore (362) are respectively defined through the centers of the upper plate (35) and the lower plate (36). Multiple upper apertures (354) are defined through and distributed on the upper plate (35). Similarly, multiple lower apertures (364) are also defined through and distributed on the lower plate (36).

The connector (37) includes a pipe (372) and a flange (374) extending outwardly around a middle section of the pipe (372). The pipe (372) is so configured that is able to extend through the upper bore (352) and the lower bore (362) and also to be force fitted with multiple washers (39) via washer holes (392) respectively defined through centers of the washers (39).

Figure 3:
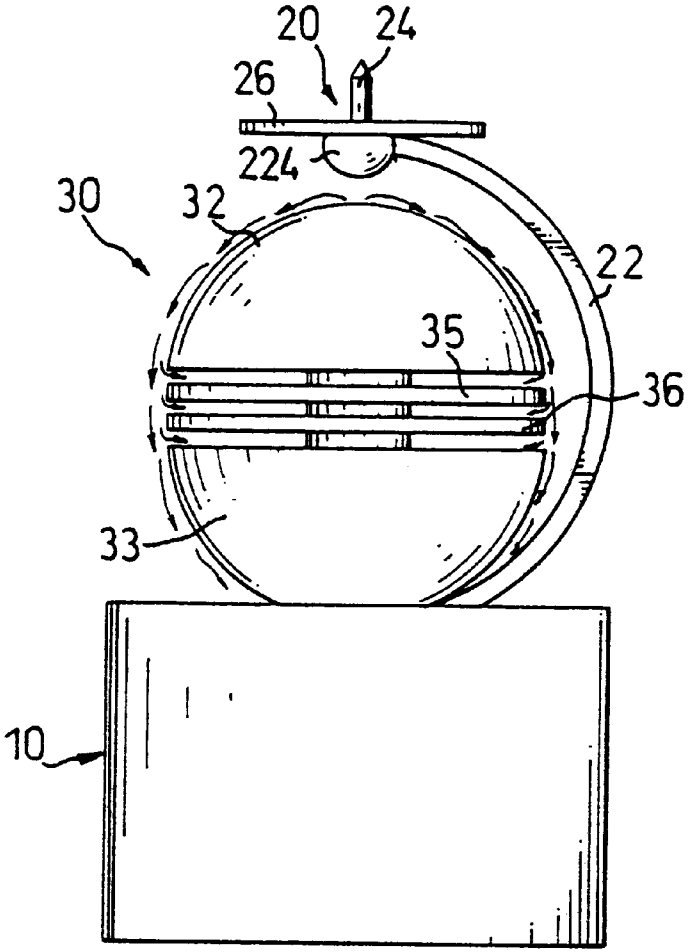
FIG. 3 is an operational, side view of a first preferred embodiment of the candle stand in combination with the fountain.

With reference to FIGS. 2 and 3, in a first preferred embodiment, components of the fountain assembly (30) are put together in the following sequence:

Firstly, a bottom end of the tube (38) is extended into the interior of the base (10) to communicate with the pump (14) via the communicating hole (2222) while a top end of the tube (38) is located above the bottom end (222) of the bracket (22). Secondly, the connector (37) is disposed to allow the top end of the tube (38) to be force fitted inside a bottom portion of the pipe (372). Thirdly, the lower plate (36) is placed on the flange (374) while a top portion of the pipe (372) extends through the lower bore (362), and one of the washers (39) further mounts around the top portion of the pipe (372) to rest on the lower plate (36). Fourthly, the upper plate (35) is then placed on the washer (39) resting on the lower plate (36) while the top portion of the pipe (372) extends through the upper bore (352). Finally, another one of the washers (39) is force fitted around the top portion of the pipe (372) and retained above the upper plate (35) to further hold the top semisphere (32) on top while the top portion of the pipe (372) communicates with the top bore (322).

With reference to FIG. 3, when in operation of the candle stand in combination with the fountain, a suitable amount of water is added into the base (10). The pump (14) is then turned on so that the water is pumped from the base (10) through the pipe (372) and spills over the top of the top semi-sphere (32). The water flows down an outside face of the top semi-sphere (32) until some of the water drips down from an edge of the outside face while other water flows into a space between the top semi-sphere (32) and the bottom semi-sphere (33) and drips onto the upper plate (35). The water dripped onto the upper plate (35) then drips onto the lower plate (36) via the upper apertures (354) and similarly, the water further drips via the lower apertures (364) to be collected by the bottom semi-sphere (33) until the bottom semi-sphere (33) reaches its capacity. When the capacity is reached, this water again spills over and flows onto the cover plate (12). All of the water regardless of the routes taken is finally collected on the cover plate (12) and enters the base (10) via the through holes (122) to be recycled by the pump (14).

Figure 4:
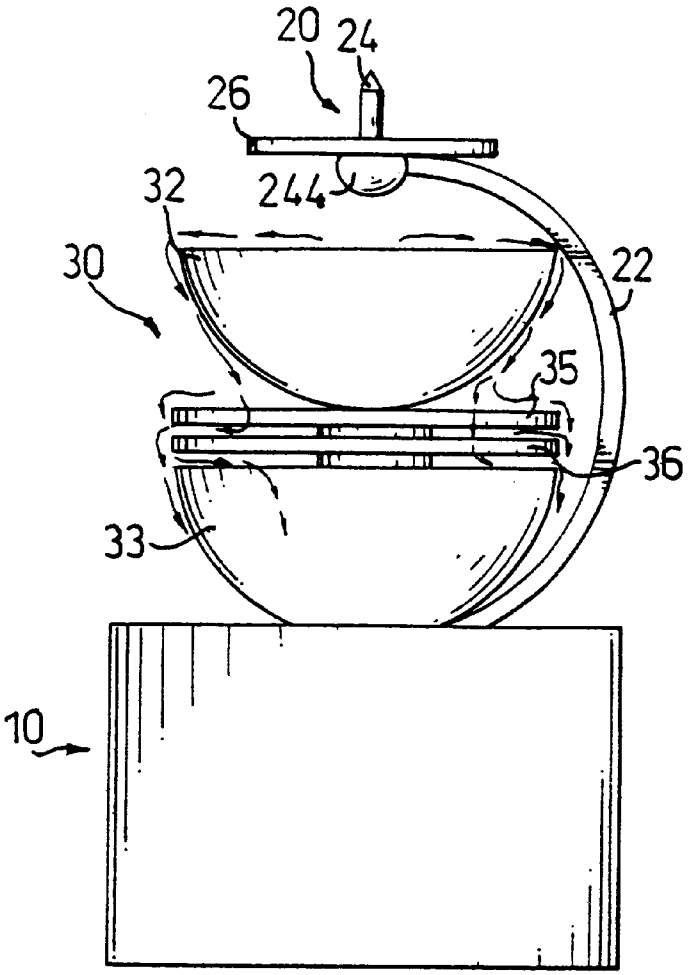
FIG. 4 is an operational, side view of a second preferred embodiment of the candle stand in combination with the fountain.

With reference to FIG. 4, in a second preferred embodiment, the fountain (30) is rearranged such that the top-semi sphere (32) faces the opposite direction comparing with the first preferred embodiment. Other components remain unchanged and therefore detail description concerning the assembly and operation of the second preferred embodiment is omitted.

From the above description, it is noted that the invention has the following advantages:

1. combined ornamental effect. The candle stand in combination with the fountain combines the advantages and the ornamental effects of a candle stand and a fountain.
2. rearrangeable configuration. The components of the candle stand in combination with the fountain are rearrangeable to provide versatile configurations.

While this invention has been particularly shown and described with references to the preferred embodiment thereof, it will be understood by those skilled in the art that various changes in form and details may be made therein without departing from the scope of the invention encompassed by the appended claims.

What is claimed is:

1. A candle stand in combination with a fountain, comprising:

a base being hollow and having a top opening defined therein, the base including:

a cover plate covering the top opening and having multiple through holes defined on the cover plate; and a pump disposed inside the base and adapted to be connected to a power supply;

a candle stand assembly mounted on the base and including:

a bracket having a lower end connected to the cover plate;

a pointed screw threadingly connected to an upper end of the bracket; and a candle plate mounted on the upper end of the bracket;

a fountain assembly mounted on the base and including:

a connector being hollow;

a tube communicating the connector to the pump;

a bottom semi-sphere disposed around the connector and on top of the cover plate;

a top semi-sphere disposed around the connector and above the cover plate;

an upper plate disposed around the connector and between the bottom semi-sphere and the top semi-sphere, and having multiple upper apertures defined through the upper plate; and a lower plate disposed around the connector and between the bottom semi-sphere and the top semi-sphere, and having multiple lower apertures defined through the lower plate.

2. The candle stand in combination with the fountain as claimed in claim 1 further comprising a first washer mounted around the connector and between the top-semi sphere and the upper plate.

3. The candle stand in combination with the fountain as claimed in claim 2 further comprising a second washer mounted around the connector and between the bottom-semi sphere and the lower plate.

4. The candle stand in combination with the fountain as claimed in claim 3, wherein the bracket of the candle stand assembly is arcuate.

* * * * *